US006782986B2

(12) United States Patent
Toda et al.

(10) Patent No.: US 6,782,986 B2
(45) Date of Patent: Aug. 31, 2004

(54) SHEET COUNTING APPARATUS, SHEET COUNTING METHOD AND TRANSACTION APPARATUS

(75) Inventors: Kinya Toda, Kyoto (JP); Masaki Yamada, Kyoto (JP); Toshiya Hamasaki, Kyoto (JP); Toru Fujii, Kyoto (JP)

(73) Assignee: Omron Corp., Kyoto (JP)

( * ) Notice: Subject to any disclaimer, the term of this patent is extended or adjusted under 35 U.S.C. 154(b) by 0 days.

(21) Appl. No.: 09/809,303

(22) Filed: Mar. 16, 2001

(65) Prior Publication Data

US 2001/0035329 A1 Nov. 1, 2001

(30) Foreign Application Priority Data

Mar. 16, 2000 (JP) ..... P. 2000-074059

(51) Int. Cl.[7] ..... B65H 7/02; G07F 7/04
(52) U.S. Cl. ..... 194/206; 271/265.04
(58) Field of Search ..... 194/205–207, 194/212, 335; 271/111, 259, 261, 262, 263, 265.02, 265.03, 265.04

(56) References Cited

U.S. PATENT DOCUMENTS 4,365,700 A * 12/1982 Arimoto et al. ..... 194/206
4,487,306 A * 12/1984 Nao et al. ..... 194/207
5,174,562 A * 12/1992 Mizunaga et al. ..... 271/261
5,363,949 A * 11/1994 Matsubayashi ..... 194/206
5,655,668 A * 8/1997 Drenth ..... 209/603
5,727,692 A * 3/1998 Large et al. ..... 209/577

FOREIGN PATENT DOCUMENTS

| | | |
|---|---|---|
| JP | 05046842 | 2/1993 |
| JP | 111 20 414 | 10/1997 |
| KR | 1992-15511 | 8/1992 |
| KR | 1999-79749 | 11/1999 |

* cited by examiner

*Primary Examiner*—Dean J. Kramer
(74) *Attorney, Agent, or Firm*—Dickstein Shapiro Morin & Oshinsky LLP

(57) ABSTRACT

The bill counter has thickness detection units 31, 32, and 33 for detecting the thickness of a bill passing through a transport passage. The thickness detection units 31, 32, and 33 are separately placed on the transport passage. Waveform outputs from the thickness detection units 31, 32, and 33, provided by detecting the thicknesses of predetermined parts of bill passing through the transport passage are compared with waveform data previously stored in a storage unit and the number of bills passing through the transport passage is determined.

3 Claims, 9 Drawing Sheets

FIG.8

| | PAPER PASSAGE PATTERN | THICKNESS DETECTION SENSOR WAVEFORM | NUMBER-OF-BILLS DETERMINATION ENABLE OR DISABLE |
|---|---|---|---|
| P1 | THREE-BILL SHIFT | | ENABLE |
| P2 | SKEW IN THREE-BILL SHIFT | | ENABLE |
| P3 | TWO-BILL FIT | | ENABLE |
| P4 | ONE-BILL LENGTH FOLD, SMALL | 1.5 1.0 1.0 | ENABLE |
| P5 | ONE-BILL LENGTH FOLD, LARGE | 0.5 2.0 1.5 | DISABLE |
| P6 | ONE-BILL LENGTH BREAK | 1.0 0.5 1.0 | ENABLE |

SHEET COUNTING APPARATUS, SHEET COUNTING METHOD AND TRANSACTION APPARATUS

BACKGROUND OF THE INVENTION

1. Field of the Invention

This invention relates to a sheet counting apparatus, a sheet counting method and a transaction apparatus being contained in an automatic dealing apparatus such as an automated-teller machine (ATM) or an automatic ticket dispenser for counting the number of sheets.

2. Description of the Related Art

A bill counter for counting the number of bills as sheets is placed in a transport passage of the paying-in side and a transport passage of the paying-out side. As an example, a structure on the paying-out side in a related art will be discussed.

In the related art, in paying-out processing, bills are separated and paid out one by one from a paying-out section of a cartridge. In this case, bills paid out in an overlap state because of a separation failure, skewed bills, or broken bills cannot be checked for validity in a validation section or cannot be counted in a count section and are collected, and stored in a reject collection box without undergoing paying-out processing.

Since the number of rejected bills is unknown, there is a problem of making it impossible to manage the balance of cash in the apparatus.

To solve such a problem, counters, for example, as described in Japanese Patent Unexamined Publication No. Hei. 11-120414 and Japanese Patent Unexamined Publication No. Hei. 5-46842 are already invented.

The counter described in the above-mentioned Japanese Patent Unexamined Publication No. Hei. 11-120414 comprises a thickness sense mechanism placed at an intermediate point of a transport passage. Thickness sense mechanism comprises a sense roller, which is supported rotationably by a reference roller rotated with drive means, for directly measuring the thickness of a passed-through bill by a proper press force. Displacement of the sense roller indicating the thickness of the bill is measured using an angle sensor, as the rotation angle of a support shaft of the sense roller.

In such a configuration, the number of overlapped bills in transport among the paid-out bills can be determined. However, in the structure in the related art, the thickness sense mechanism measures only the thickness of a specific single line in a transport direction of each bill. Thus if the bill is skewed, broken, or torn, the number of bills cannot be determined; this is a problem.

The counter described in the above-mentioned Japanese Patent Unexamined Publication No, Hei. 5-46842 uses both a thickness sense mechanism and read means such as an image reader. Thickness sense mechanism senses the thickness of a bill. The read means reads the outer shape of overlapped bills in transport and extracts the pattern of each bill based on the image of the outer shape. Thus the number of bills is determined.

However, in the structure in this related art, it is also difficult to determine the number of bills because of change in the outer shape caused by breaking or tearing the bills. Further, since outer shape extraction processing from an image (pattern extraction processing based on the outer shape image) is required, processing is intricate and unstable and is inferior in practical use.

Such problems are not limited to paying-out processing or bills and are also common to paying-in processing and other sheets.

SUMMARY OF THE INVENTION

It is therefore an object of the invention to provide a sheet counting apparatus, a sheet counting method and a transaction apparatus capable of determining the number of passage sheets even in various transport patterns where an overlap in transport, a skew, a fold, or a break occurs.

It is another object of the invention to provide a sheet counting apparatus and a transaction apparatus for making it possible to determine the number of sheets based on the length of each sheet in the length direction thereof rather than the outer shape of the sheet, facilitate computation processing to determine the number of sheets, and measure in real time. The sheet counting apparatus and the transaction apparatus can also effectively count the number of sheets transported at high speed.

According to the invention, there is provided a sheet counting apparatus for counting the number of sheets, comprising a plurality of thickness detection units for detecting the thickness of a sheet passing through a transport passage. In the sheet counting apparatus, the plurality of the thickness detection units are separately placed on the transport passage, wherein waveform outputs from the plurality of the thickness detection units, which provided by detecting the thicknesses of predetermined parts of sheets passing through the transport passage, are compared with waveform data previously stored in a storage unit, and the number of sheets passing through the transport passage is determined.

According to the configuration, the thicknesses of the sheets passing through the transport passage are detected separately by the thickness detection units separately provided at predetermined parts, and the waveform outputs provided by the plurality of the thickness detection units are compared with the waveform data, so that if an overlap in transport, a skew, a fold, or a break occurs in the passage sheets, the number of the sheets can also be determined.

It is preferable that the sheet counting apparatus further comprises an image pickup unit for picking up an image of each sheet passing through the transport passage, wherein when a sheet is determined to be broken or folded based on the waveforms provided by the thickness detection units and image pickup information provided by the image pickup unit, the number of sheets passing through the transport passage is determined by using the image pickup information.

According to the configuration, if it is hard to determine the number of passage sheets based only on the waveform outputs provided by the plurality of the thickness detection units, the image pickup information provided by the image pickup unit is used for processing, whereby it is made possible to determine the number of sheets and particularly the sheet counting apparatus becomes useful when a single-sheet fold occurs in the length direction of the sheet or a sheet is broken in the vicinity of the center of the sheet.

It is also preferable that when the number of passage sheets calculated based on the waveform output provided by one of the thickness detection units differs from that calculated based on the waveform output provided by any other thickness detection unit, the number of passage sheets is determined by using length information in the sheet length direction provided as the image pickup information provided by the image pickup unit.

According to the configuration, if the waveforms from the plurality of the thickness detection units differ and it is hard to determine the number of passage sheets based only on the waveform outputs, the length information in the sheet length direction in the image pickup information is also used for integrated processing, whereby it is made possible to determine the number of sheets and particularly the sheet counting apparatus becomes useful, when a single-sheet fold occurs in the length direction of the sheet.

It is preferable that the sheet counting apparatus further comprises an output unit for outputting information to the effect that the number of sheets is undefined when the number of passage sheets cannot be determined.

According to the configuration, the output unit outputs the information indicating that the number of sheets is undefined, so that when the number of sheets cannot be determined, appropriate processing can be executed. That is, in the related art, determination of the number of sheets is ambiguous and it is hard to determine the number of sheets, but the configuration makes it possible to distinctly determine whether or not the number of sheets can be determined.

To deal with paid-out bills based on the information output indicating that the number of bills is undefined, the bills may be collected or the person in charge may be informed of the fact; to deal with paid-in bills, the bills maybe rejected.

It is preferable that the thickness detection units detect the center and both end parts of each passage sheet in the length direction thereof.

According to the configuration, if an overlap in transport, a skew, a fold, or a break occurs in the passage bills, the number of the bills can also be determined with the necessary minimum thickness detection unit.

According to the invention, there is provided a transaction apparatus comprising one of the sheet counting apparatus described above. According to the configuration, the number of bills can be managed smoothly.

BRIEF DESCRIPTION OF THE DRAWINGS

FIG. 8 is a schematic representation to show sensor waveform examples corresponding to bill passage patterns.

DETAILED DESCRIPTION OF THE PREFERRED EMBODIMENT

Referring now to the accompanying drawings, there is shown a preferred embodiment of the invention.

Figure 1:
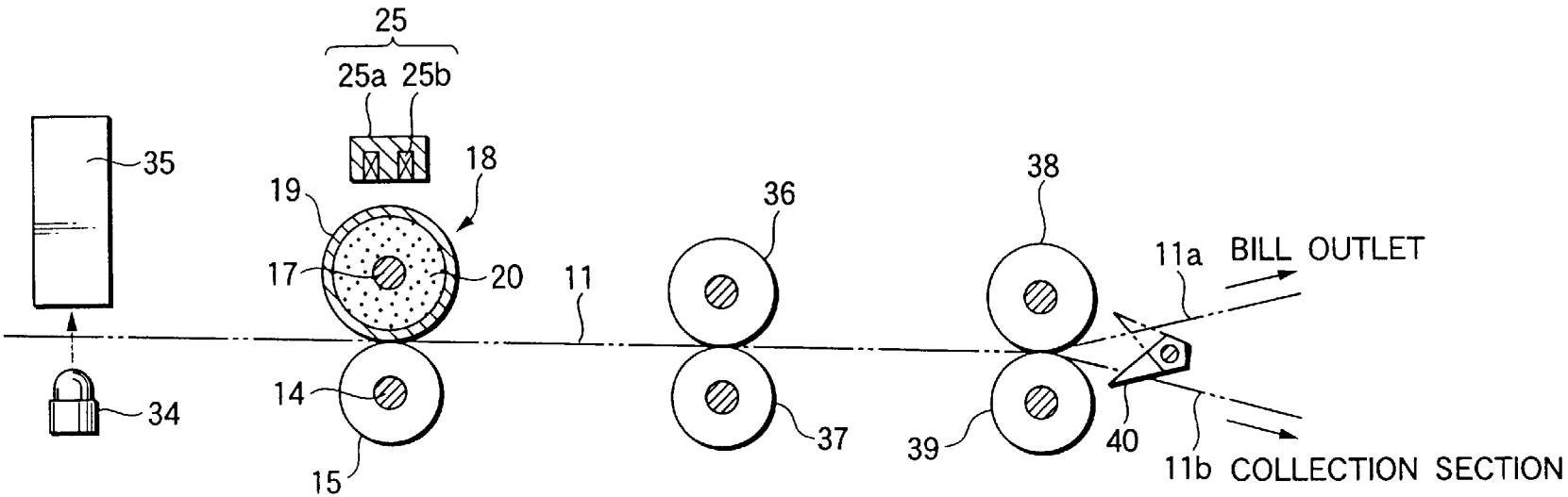
FIG. 1 is a side view of the main part of a transaction apparatus comprising a bill counter of the invention.
Figure 2:
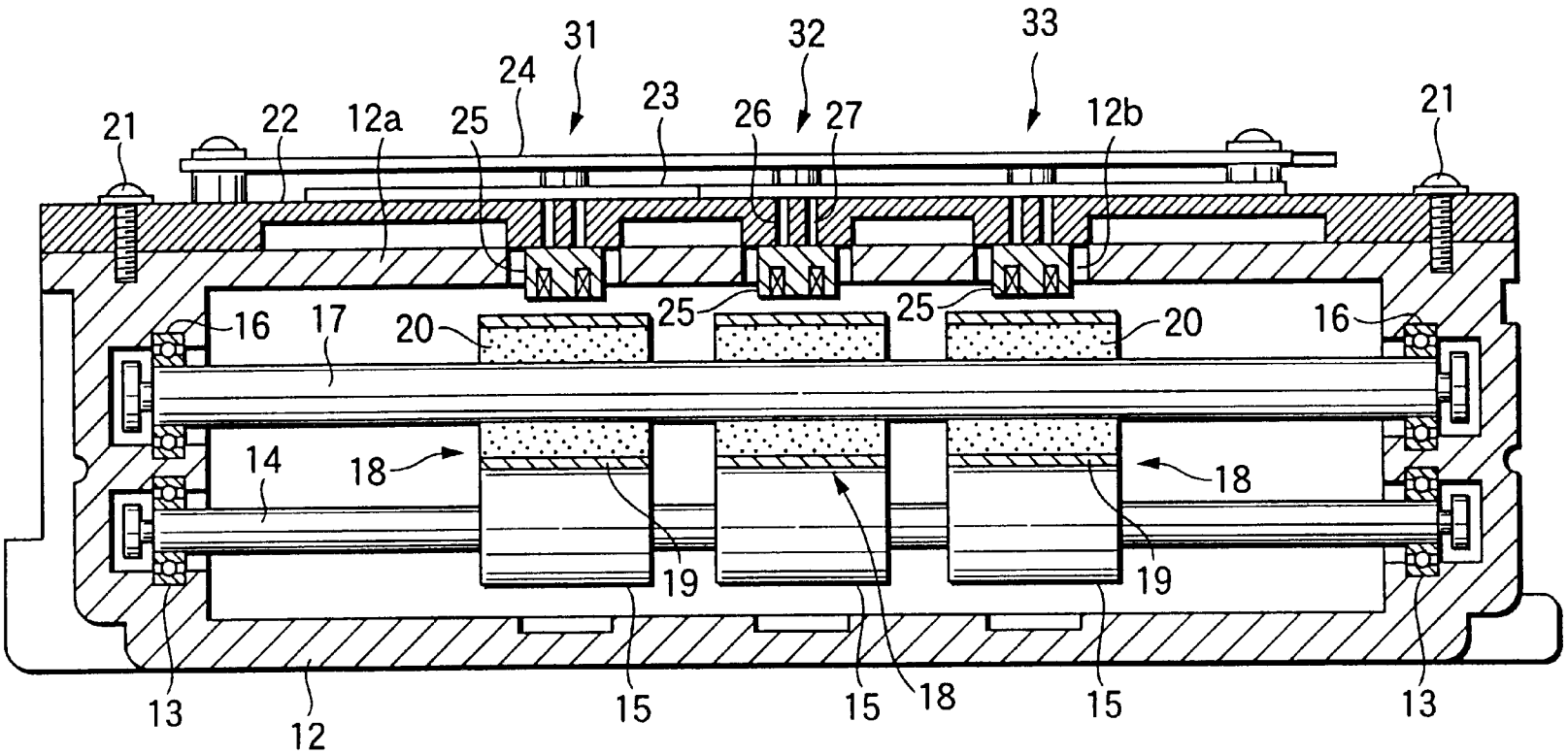
FIG. 2 is a front view of the bill counter.
Figure 3:
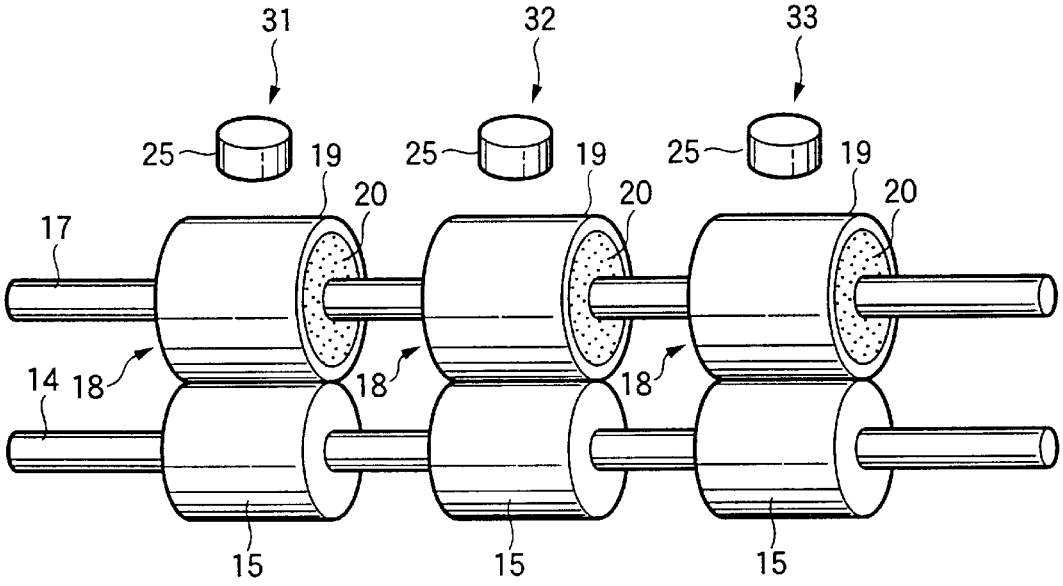
FIG. 3 is a perspective view of the bill counter.

The drawings show a transaction apparatus comprising a bill counter for counting the number of bills as an example of sheets. In FIGS. 1, 2, and 3, the transaction apparatus comprises a transport passage 11 and a counter main unit 12. The transport passage 11 connects a cartridge and a bill outlet or a collection section. A reference roller shaft 14 is placed horizontally for rotation via bearings 13 and 13 in the counter main unit 12 at an intermediate point of the transport passage 11.

Reference rollers 15 are attached to the reference roller shaft 14 so as to correspond to the center and both end parts of each bill in the length direction thereof.

A roller shaft 17 is placed horizontally for rotation via bearings 16 and 16 in the counter main unit 12 on the transport passage 11 so that it becomes parallel with the reference roller shaft 14.

Driven rollers 18 are attached to the roller shaft 17 so as to face the reference rollers 15 in an up and down direction. Each driven roller 18 consists of a metal pipe 19 of an outer peripheral portion and a rubber member 20 sealed in between the pipe 19 and the roller shaft 17. The rubber member 20 is distorted in response to the thickness of a bill, whereby the metal pipe 19 becomes displaced independently of any other metal pipe 19.

On the other hand, as shown in FIG. 2, a spacer 22 is placed on and fixed to an upper wall part 12*a* of the counter main unit 12 with mounting members 21 and 21 such as screws. An analog processing board 23 is attached to the top of the spacer 22 and the top of the board 23 is covered with a cover member 24.

The upper wall part 12*a* is formed with openings 12*b* opposed to the placement positions of the driven rollers 18. A magnetic coil 25 consists of a core part 25*a* and a coil part 25*b* (see FIG. 1), and is placed in each opening 12*b* and is connected to the analog processing board 23 via line 26, 27.

Both the driven roller 18 and the magnetic coil 25 make up each of thickness detection sensors 31, 32, and 33 as thickness detection unit corresponding to one end part, a center part, and an opposite end part of each bill in the length direction thereof (see FIGS. 2 and 3).

The thickness detection sensors 31, 32, and 33 separately detect the thickness of a bill passing through the transport passage 11; each thickness detection sensor detects displacement of the driven roller 18 by the magnetic coil 25 and converts the mechanical displacement amount of the driven roller 1 into voltage change (electric amount) by the magnetic coil 25 for providing an electric thickness detection signal.

At the stage preceding the transport passage 11 where the reference rollers 15 and the driven rollers 18 are disposed (at the left of FIG. 1 (upstream)), a light source 34 in a lower part and a CCD image sensor (CCD array) 35 in an upper part as image pickup unit for picking up an image of a bill (determination unit) are placed facing each other.

The CCD image sensor 35 (so-called image sensor) scans a passage bill and picks up an image of the bill, thereby inputting the bill image as image pickup information and reading the pattern, thereby detecting the transport state, validity, denomination, and transport direction of the bill.

At the stage following the transport passage 11 where the reference rollers 15 and the driven rollers 18 are disposed, transport rollers 36 and 37 facing each other up and down are disposed, and further transport rollers 38 and 39 facing each other up and down are also disposed at the stage following the transport rollers 36 and 37 (at the right of FIG. 1 (downstream)).

At the stage following the transport rollers 38 and 39, the transport passage 11 is separated into a paying-out line 11*a* to the bill outlet and a collection line 11*b* to the collection section, and a flapper 40 as sort means for sorting each transported bill to either the line 11*a* or the line 11*b* is provided between the lines 11*a* and 11*b*.

Figure 4:
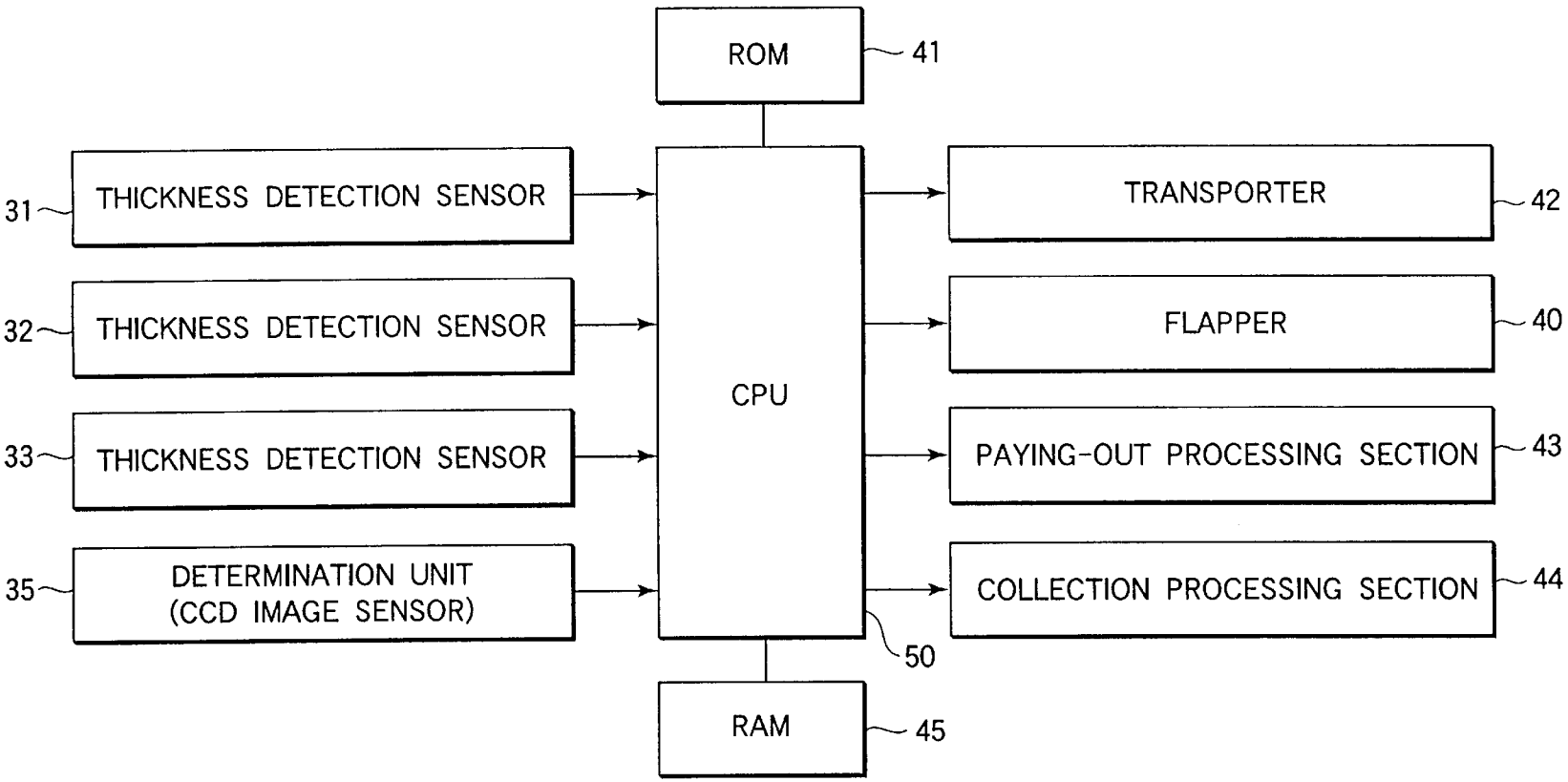
FIG. 4 is a block diagram of a control circuit of the transaction apparatus.
Figure 9:
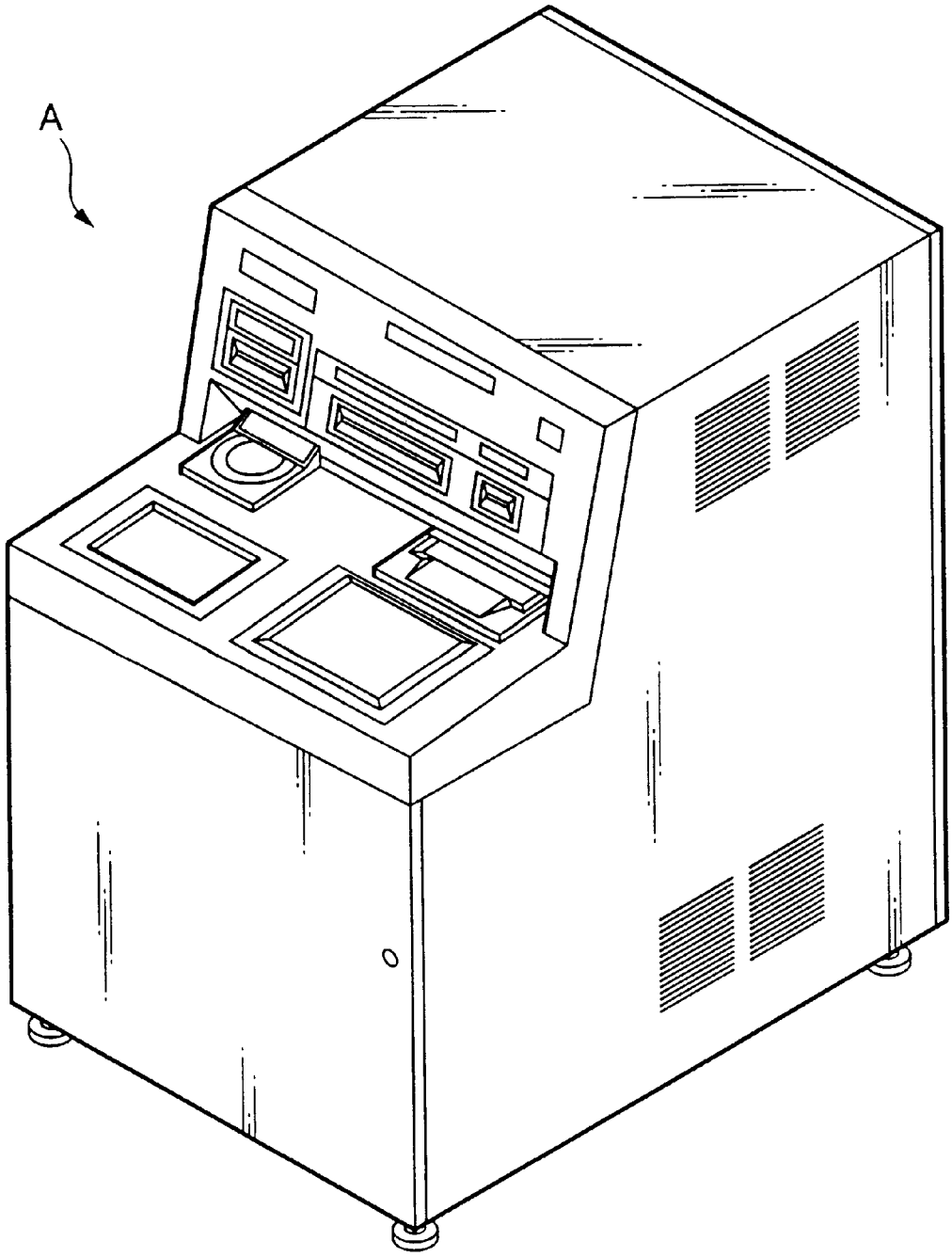
FIG. 9 is an external view of the transaction apparatus.

FIG. 4 shows a control circuit of the transaction apparatus. A CPU 50 (control unit) controls a transporter 42, the flapper 40, a paying-out processing section 43, and a collection processing section 44 in accordance with a program stored in ROM 41 based on a digital signal from the analog processing board 23 (not shown in FIG. 4) and an image pickup information signal from the CCD image sensor 35. The digital signal is a signal converted by the analog processing board 12 from an analog signal provided by each of the thickness detection sensors 31, 32, and 33. RAM 45 is a storage unit for storing necessary data such as predetermined range data of skew angle and a table. The outer appearance of transaction apparatus A is as shown in FIG. 9.

The CPU 50 serves as number-of-bills determination unit, an information addition unit and an output unit. The number-of-bills determination unit integrally processes waveform outputs of the sensors 31, 32, and 33 provided by detecting the thicknesses of a total of three parts of each bill passing through the transport passage 11, and determines the number of bills passing through the transport passage 11 (see steps S3, S10, and S13 of a flowchart shown in FIG. 7). The information addition unit uses image pickup information provided by the CCD image sensor 35 when the number of passage bills calculated based on the sensor waveform output provided by one of the thickness detection sensors 31, 32, and 33 differs from that calculated based on the sensor waveform output provided by any other thickness detection sensor (see steps S9 and S13 of the flowchart shown in FIG. 7). The output unit outputs information to the effect that the number of bills is undefined when the number of passage bills cannot be determined (see steps S8 and S14 of the flowchart shown in FIG. 7).

Figure 5:
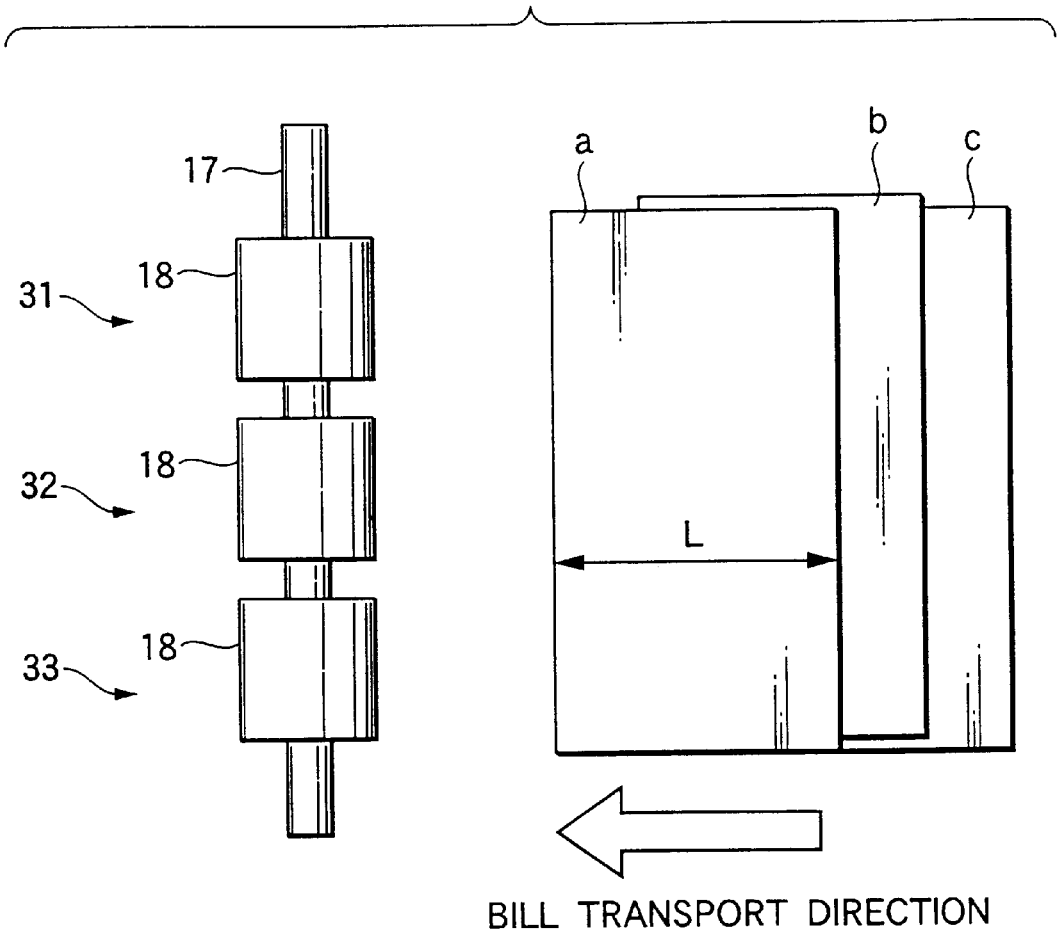
FIG. 5 is a partial plan view to describe number-of-bills determination processing.
Figure 6:
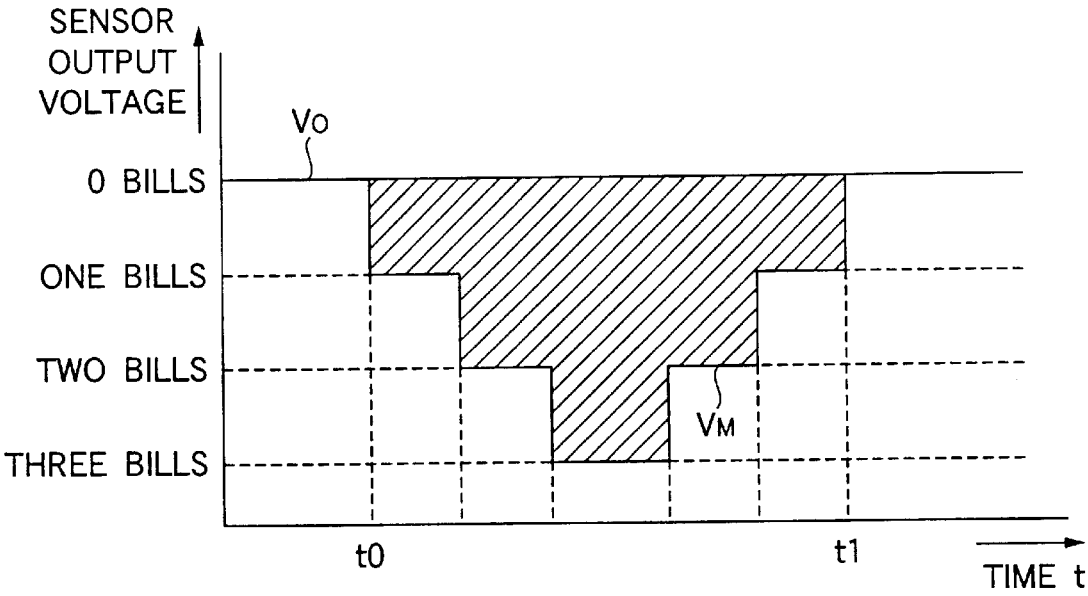
FIG. 6 is a drawing of an output voltage change state to describe number-of-bills determination processing.

Next, a determination method of the number of passage bills by the thickness detection sensors 31, 32, and 33 will be discussed with reference to FIGS. 5 and 6.

Sensor output voltage Vm of the thickness detection sensor 31, 32, 33 (Vo at 0-bill level) is set so as to become high when the spacing with the driven roller 18 is large and low when the spacing with the driven roller 18 is small. Thus, for example, if three overlapped bills a, b, and c (see FIG. 5) pass through the thickness detection sensors, the output signal waveform of one thickness detection sensor (waveform of voltage change relative to time) becomes as shown in FIG. 6.

That is, the sensor output voltage Vm when the bills a, b, and c do not reach is the largest and becomes the voltage value Vo. At time to at which only the top bill a reaches, the sensor output voltage Vm becomes small in response to one bill. At the time at which the two-bill overlap part of the bills a and b reaches, the sensor output voltage Vm becomes smaller in response to the two bills. At the time at which the three-bill overlap part of the bills a, b, and c reaches, the sensor output voltage Vm becomes further smaller in response to the three bills.

When the three overlapped bills a, b, and c pass through the thickness detection sensors, the sensor output voltage Vm is restored to the former state Vo at sensor output at time t1.

Therefore, if the integral of the difference between the sensor output voltage Vm and the voltage value Vo at the 0-bill level of the changing sensor voltage Vm (output value) (see the area of the portion hatched in FIG. 6) is divided by length L of a bill in the short length direction thereof as a known value previously stored in the ROM 41 or the RAM 45, the number of bills passing through the thickness detection sensors can be found.

$$m = \frac{\int_{t_0}^{t_1} (V_0 - V_m)dt}{L}$$

Thus, the waveform as described above (see FIG. 6) is provided from each of the separate thickness detection sensors 31, 32, and 33, whereby the waveform train can be provided corresponding to various bill passage patterns P1 to P6 as shown in FIG. 8. Accordingly, if the contents shown in FIG. 8 are converted into data and the data is stored in the RAM 45 (storage unit) as a table, the number of passage bills can be easily determined.

Numeric values 0.5, 1.0, 1.5, and 2.0 entered in FIG. 8 correspond each to the number of overlapped bills. For example, the numeric value 1.0 corresponds to the thickness of one bill and 2.0 corresponds to the thickness of two bills.

As shown in FIG. 8, the pattern P1 is applied if a plurality of bills are shifted simply in the transport direction and are overlapped in transport, and the pattern P3 is applied if a plurality of bills are completely overlapped in transport. In such a case, the output waveforms of the thickness detection sensors 31, 32, and 33 become the same. The pattern P2 is applied if the overlapped bills contain a skewed bill. In this case, the output waveforms of the thickness detection sensors 31, 32, and 33 do not become the same, and the passage distance where the bills pass through the placement portion of the thickness detection sensor is extended because of the skewed bill and the area corresponding to the hatched portion in FIG. 6 is widened accordingly. The pattern P4 and P5 are applied if the bill is folded in the length direction. In this case, the output waveforms of the thickness detection sensors 31, 32, and 33 do not become the same, and the output waveform of the thickness detection sensor which detects the portion where the bill is folded becomes not less than "1.0" waveform, for example, the output waveform of the thickness detection sensors 32 is "2.0" corresponding to the thickness of two bills in the pattern P5. The pattern P6 is applied if the bill is broken in the length direction. In this case, for example, the output waveform of each of the thickness detection sensors 31 and 33 at both end parts becomes "1.0" waveform corresponding to the thickness of one bill, and the output waveform of the thickness detection sensors 32 at the center becomes a waveform of less than one bill, such as "0.5" waveform.

Figure 7:
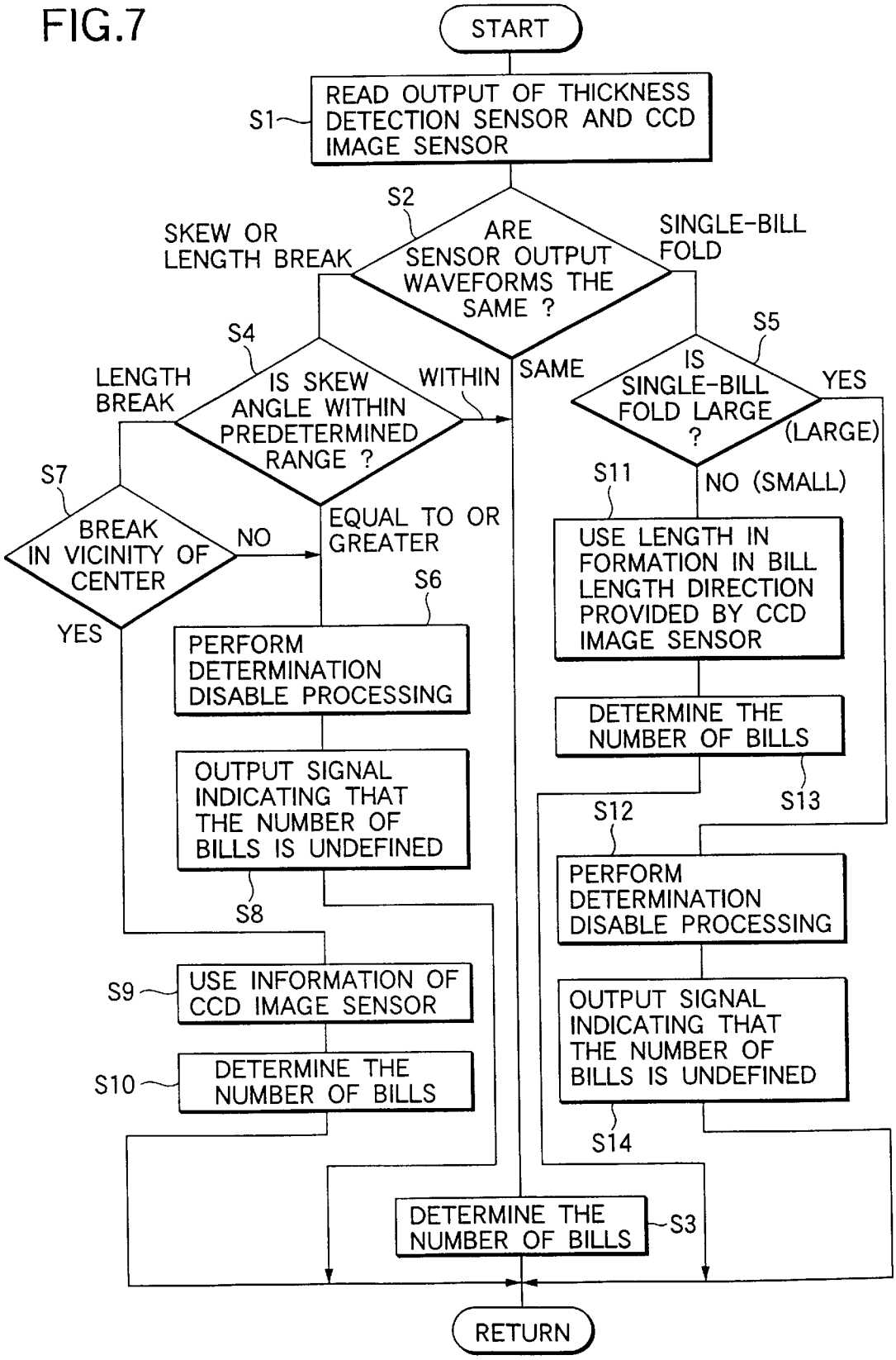
FIG. 7 is a flowchart to show number-of-bills determination processing.

The operation of the described transaction apparatus will be discussed in detail with reference to the flowchart of FIG. 7.

If the paying-out processing section 43 and the transporter 42 are driven in response to a paying-out request, paid-out bills are transported from the cartridge.

When the bill transported on the transport passage 11 passes through the placement portion of the light source 34 and the CCD image sensor 35, and the placement portion of the reference rollers 15 and the driven rollers 18, at the first step the CPU 50 reads signals from the thickness detection sensors 31, 32, and 33 and a signal from the CCD image sensor 35.

Next, at the second step S2, the CPU 50 determines whether or not the output waveforms of the thickness detection sensors 31, 32, and 33 are the same. If the pattern P1 or P3 shown in FIG. 8 is applied, the output waveforms become the same; if any other pattern P2, P4, P5, or P6 is applied, the output waveforms become different.

The pattern P1 is applied if a plurality of bills are shifted simply in the transport direction and are overlapped in transport, and the pattern P3 is applied if a plurality of bills are completely overlapped in transport. In such a case, the output waveforms of the thickness detection sensors 31, 32, and 33 become the same. Then, the CPU 50 goes to the third step S3.

If the pattern P2, P4, P5, or P6 is applied, the output waveforms of the thickness detection sensors 31, 32, and 33 become different. If the pattern P2 (skew) or the pattern P6 (length break) shown in FIG. 8 is applied, the CPU 50 goes to the fourth step S4. If the pattern P4 or PS shown in FIG. 8 (single-bill fold in length direction) is applied, the CPU 50 goes to the fifth step S5. The judgment of the pattern P2, P4, P5 or P6 of the bill may be performed on the basis of only the output waveforms of the thickness detection sensors 31, 32 and 33, and may be performed on the basis of the output waveforms of the thickness detection sensors 31, 32 and 33 and the image information provided by the CCD image sensor.

At the third step S3, the CPU 50 determines the number of bills in response to the fact that the output waveforms of the thickness detection sensors 31, 32, and 33 are the same, and transports the bills whose number is determined via the paying-out line 11*a* to the bill outlet.

On the other hand, at the fourth step S4, the CPU 50 determines whether or not the skew angle in the pattern P2 shown in FIG. 8 is within a predetermined range based on the output waveforms from the thickness detection sensors 31, 32, and 33. If the skew angle is within the predetermined range, the CPU SO goes to the third step S3; if the skew angle is equal to or greater than the predetermined range, the CPU 50 goes to the sixth step S6. If it is determined that the pattern P6 (length break) rather than the pattern P2 is applied, the CPU 50 goes to the seventh step 57.

The pattern P2 shown in FIG. 8 is applied if the overlapped bills contain a skewed bill. In this case, the output waveforms of the thickness detection sensors 31, 32, and 33 do not become the same. The passage distance where the bills pass through the placement portion of the thickness detection sensor is extended because of the skewed bill and the area corresponding to the hatched portion in FIG. 6 is widened accordingly. If the skew angle is at a level that can occur in the bill transporter, namely, is within the predetermined range, a large difference does not occur, in which case the CPU 50 goes to the third step S3 and determines the number of bills.

On the other hand, if the skew angle is equal to or greater than the predetermined range and it is hard to determine the number of bills, the CPU 50 goes to the sixth step S6 and executes determination disable processing. Then, at the eighth step S8, the CPU outputs a signal indicating that the number of bills is undefined. This means that the flapper 40 is switched for collecting the paid-out bill in the collection section via the collection line 11*b*. At the eighth step S8, the person in charge may be informed of the fact and may count the number of bills before the bills are collected.

If it is determined at the fourth step S4 that length break rather than skew is applied, the CPU 50 goes to the seventh step S7.

At the seventh step S7, the CPU 50 determines whether or not the length break state is a break in the vicinity of the center in the pattern P6 shown in FIG. 8 based on the output waveforms from the thickness detection sensors 31, 32, and 33. If the length break state is a break in the vicinity of the center (pattern P6), the output waveform of each of the thickness detection sensors 31 and 33 at both end parts becomes "1.0" waveform corresponding to the thickness of one bill and the output waveform of the thickness detection sensors 32 at the center becomes a waveform of less than one bill, such as "0.5" waveform. Thus, when it is determined at the seventh step S7 that the length break is a break in the vicinity of the center (pattern P6), the CPU 50 goes to the ninth step S9; when No is returned at the seventh step S7 (the break degree is large and it is hard to determine the number of bills), the CPU 50 goes to the sixth step S6.

At the ninth step S9, the CPU 50 uses preread information of the CCD image sensor 35 and checks that the length break is a break in the vicinity of the center from image data according to the image pickup information from the image sensor 35

Next, at the tenth step S10, the CPU 50 determines the number of bills (in this case, one bill) and transports as many bills as the determined number of bills to the bill outlet via the paying-out line 11*a*.

On the other hand, when single-bill fold corresponding to the pattern P4 or P5 in FIG. 8 is applied, the CPU 50 goes to the fifth step S5 and determines whether or not the single-bill fold is large. If the single-bill fold degree is small and the output waveform of the thickness detection sensor at one end part is larger than "1.0" waveform and each of the output waveforms of other two thickness detection sensors is "1.0" waveform as shown in the pattern P4 in FIG. 8, the CPU 50 determines that the single-bill fold is not large, and goes to the eleventh step S11. If the single-bill fold degree is large and the output waveforms of all the thickness detection sensors differ as shown in the pattern P5 in FIG. 8, the CPU 50 determines that the single-bill fold is large, and goes to the twelfth step S12.

At the eleventh step S11, the CPU 50 uses the length information in the bill length direction provided by the CCD image sensor 35 in response to the fact that the single-bill fold degree is small. If the length in the length direction is a little shorter than a predetermined value, the number of bills can be determined and thus the CPU 50 goes to the thirteenth step S13.

At the thirteenth step S13, the CPU 50 determines the number of bills and transports as many bills as the determined number of bills to the bill outlet via the paying-out line 11*a*.

On the other hand, at the twelfth step S12 the CPU 50 executes determination disable processing in response to the fact that the single-bill fold degree is large, and at the fourteenth step S14, the CPU outputs a signal indicating that the number of bills is undefined. This means that the flapper 40 is switched for collecting the paid-out bills in the collection section via the collection line 11*b*. At the fourteenth step S14, the person in charge may be informed of the fact and may count the number of bills before the bills are collected.

As described above, in short, the bill counter of the embodiment comprises the thickness detection sensors 31, 32, and 33 being placed separately on the transport passage 11 as the thickness detection unit for detecting the thicknesses of the bills a, b, and C (see FIG. 5) passing through the transport passage 11. The bill counter compares a plurality of sensor waveform outputs provided by detecting the thicknesses of the predetermines parts of the bills a, b, and c passing through the transport passage 11 with the waveform data stored in the storage unit (RAM 45), and determines the number of the bills a, b, and c passing through the transport passage 11.

Consequently, the thicknesses of the bills passing through the transport passage 11 are detected separately by the thickness detection sensors 31, 32, and 33 placed separately at the predetermined parts of the bill and the sensor waveform outputs provided by the thickness detection sensors 31, 32, and 33 are compared with the waveform data, so that if an overlap in transport, a skew, a fold, or a break occurs in the passage bills, the number of the bills can also be determined.

The image pickup unit (CCD image sensor 35) for picking up the image of each bill passing through the transport passage 11 is provided, and when a bill is determined to be broken or folded based on the sensor waveforms provided by the thickness detection sensors 31, 32, and 33 and the image pickup information provided by the image pickup unit, the number of bills passing through the transport passage 11 is determined by using the image pickup information of the CCD image sensor 35. Thus, if it is hard to determine the number of passage bills based only on the sensor waveform outputs provided by the thickness detection sensors 31, 32, and 33, the image pickup information provided by the image pickup unit (CCD image sensor 35) is also used for integrated processing, whereby it is made possible to determine the number of bills and particularly the bill counter becomes useful when a single-bill fold occurs in the length direction of the bill (see the pattern P4 in FIG. 8) or a bill is broken in the vicinity of the center of the bill (see the pattern P6).

Further, when the number of passage bills calculated based on the sensor waveform output provided by one of the thickness detection sensors 31, 32, and 33 differs from that Calculated based on the sensor waveform output provided by any other thickness detection sensor, the number of bills passing through the transport passage 11 is determined by using the length information in the bill length direction provided as the image pickup information provided by the image pickup unit (CCD image sensor 35). Thus, if the sensor waveforms from the thickness detection sensor 31, 32, and 33 differ and it is hard to determine the number of passage bills based only on the sensor waveform outputs, the length information in the bill length direction in the image pickup information is also used for integrated processing, whereby it is made possible to determine the number of bills and particularly the bill counter becomes useful when a single-bill fold occurs in the length direction of the bill (see the pattern P4 in FIG. 8).

In addition, the bill counter comprises the output unit for outputting information to the effect that the number of bills is undefined (step S8, S14) when the number of passage bills cannot be determined (step S6, S12), so that the information indicating that the number of bills is undefined can be output by the output unit and when the number of bills cannot be determined, appropriate processing can be executed.

To deal with paid-out bills based on the information output indicating that the number of bills is undefined, the bills may be collected or the person in charge may be informed of the fact; to deal with paid-in bills, the bills maybe rejected.

The thickness detection sensors 31, 32, and 33 detect the center and both end parts of each passage bill in the length direction thereof and thus it an overlap in transport, a skew, a fold, or a break occurs in the passage bills, the number of the bills can also be determined with the necessary minimum thickness detection sensors 31, 32, and 33.

Further, the transaction apparatus of the embodiment comprises the described bill counter and thus can manage the number of bills smoothly.

The correspondence between the components of the invention and those of the embodiment is as follows:

The sheet counting apparatus of the invention corresponds to the bill counter of the embodiment;

likewise, the sheets correspond to the bills a, b, and c;

the thickness detection units corresponds to the thickness detection sensor 31, 32, 33;

the storage unit corresponds to the RAM 45;

the image pickup unit corresponds to the CCD image sensor 35; and the output unit corresponds to steps S8 and S14 under the control of the CPU 50.

However, the invention is not limited to the specific configuration of the embodiment described above.

For example, in the embodiment, the number of paid-out bills is counted, but the invention can also be applied to a counter for counting the number of paid-in bills and a counter for counting the number of other sheets than bills, for example, the number of sheets of paper such as copy paper, the number of cards, etc., needless to say.

According to the invention, if an overlap in transport, a skew, a fold, or a break occurs in transported sheets, the number of the passage sheets can also be determined.

What is claimed is:

1. A sheet counting apparatus for counting the number of sheets, comprising:

a plurality of thickness detection units, which are separately disposed length-wise on a transport passage of the sheets, for detecting thicknesses of the sheet passing length-wise through the transport passage; and a control unit for determining the number of sheets passing through the transport passage on the basis of the detection outputs from said thickness detection units;

wherein said thickness detection unit detects the thickness of the sheet as voltage value, and said control unit determines the number of sheets m on the basis of the following equation:

$$m = \frac{\int_{t_0}^{t_1} (V_0 - V_m)dt}{L}$$

where,

Vm: the voltage value of the thickness detection unit,

Vo: the voltage value at the 0-sheet level,

L: the length of the sheet in the short length direction, and t0–t1: the passing time of the sheet.

2. A sheet counting apparatus for counting the number of sheets, comprising:

a plurality of thickness detection units, which are separately disposed length-wise on a transport passage of the sheets, for detecting thicknesses of the sheet passing length-wise through the transport passage;

a control unit for determining the number of sheets passing through the transport passage on the basis of the detection outputs from said thickness detection units;

an output unit for outputting information that the number of sheets is undefined, when the number of passage sheets cannot be determined; and wherein said output unit outputs information that the number of sheets is undefined, when said control unit determined that the sheet is skew and an angle of skew of the sheet is larger than a predetermined value on the basis of the detection outputs.

3. A sheet counting apparatus for counting the number of sheets, comprising:

a plurality of thickness detection units, which are separately disposed length-wise on a transport passage of the sheets, for detecting thicknesses of the sheet passing length-wise through the transport passage;

a control unit for determining the number of sheets passing through the transport passage on the basis of the detection outputs from said thickness detection units;

an output unit for outputting information that the number of sheets is undefined, when the number of passage sheets cannot be determined; and wherein said output unit outputs information that the number of sheets is undefined, when said control unit determined that the sheet is single-folded and the single-fold is larger than a predetermined value on the basis of the detection outputs.

* * * * *